US010176660B2

(12) United States Patent
Schmidt et al.

(10) Patent No.: US 10,176,660 B2
(45) Date of Patent: Jan. 8, 2019

(54) METHOD AND DEVICE FOR FITNESS TESTING OF VALUE DOCUMENTS

(71) Applicant: GIESECKE & DEVRIENT GMBH, München (DE)

(72) Inventors: Alfred Schmidt, München (DE); Marcus Schmeisser, Eresing (DE); Dieter Stein, Holzkirchen (DE); Friedemann Löffler, Neuenhagen (DE); Sergii Kruglyk, Kiev (UA)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 73 days.

(21) Appl. No.: 15/325,925

(22) PCT Filed: Jul. 14, 2015

(86) PCT No.: PCT/EP2015/001444
§ 371 (c)(1),
(2) Date: Jan. 12, 2017

(87) PCT Pub. No.: WO2016/015829
PCT Pub. Date: Feb. 4, 2016

(65) Prior Publication Data

US 2017/0161981 A1 Jun. 8, 2017

(30) Foreign Application Priority Data

Jul. 15, 2014 (DE) ..... 10 2014 010 466

(51) Int. Cl.
*G07D 7/181* (2016.01)
*G07D 7/18* (2006.01)

(52) U.S. Cl.
CPC ..... *G07D 7/181* (2017.05); *G07D 7/18* (2013.01)

(58) Field of Classification Search
CPC ..... G07D 7/18; G07D 7/187; G07D 7/1205; G07D 7/202; G07D 7/181187; G01J 1/42; G01N 21/33; Y10T 428/24851
See application file for complete search history.

(56) References Cited

U.S. PATENT DOCUMENTS 6,970,235 B2 11/2005 Christophersen
7,607,528 B2 10/2009 Derks et al.
(Continued)

FOREIGN PATENT DOCUMENTS

DE 10259288 A1 7/2004
DE 60112890 T2 2/2006
(Continued)

OTHER PUBLICATIONS

German Search Report for corresponding German Application No. 102014010466.4, dated Jan. 26, 2015.
International Preliminary Report on Patentability for corresponding International PCT Application No. PCT/EP2015/001444, dated Jan. 17, 2017.
(Continued)

*Primary Examiner* — Bryan Bui
(74) *Attorney, Agent, or Firm* — Workman Nydegger

(57) ABSTRACT

The invention relates to the fitness check of value documents. For at least two fitness criteria there is respectively determined with the aid of an unfit function an unfit degree of the particular value document. The unfit function clearly assigns an unfit degree to the fitness measurement values and has two threshold values, beyond which the unfit degree with respect to the relevant fitness criterion is 0 or 1. Between the threshold values there is an uncertainty range in which the unfit degree is, with respect to the relevant fitness criterion, between 0 and 1 and the unfit function behaves monotonously dropping or monotonously rising. Subsequently, the unfit degrees of different fitness criteria are combined into an unfit probability of the particular value
(Continued)

document and on the basis of the unfit probability a fitness classification of the particular value document is carried out.

16 Claims, 5 Drawing Sheets

(56) References Cited

U.S. PATENT DOCUMENTS

| | | | | |
|---|---|---|---|---|
| 8,265,346 | B2 | 9/2012 | Blair | |
| 8,331,644 | B2 | 12/2012 | Uno | |
| 8,917,386 | B2 | 12/2014 | Holl et al. | |
| 2002/0043560 | A1 | 4/2002 | Woods et al. | |
| 2003/0030785 | A1 | 2/2003 | Christopherson | |
| 2006/0151282 | A1 | 7/2006 | Derks et al. | |
| 2008/0034313 | A1 | 2/2008 | Hildebrand | |
| 2011/0229696 | A1* | 9/2011 | Ratnukumar ..... | G07D 7/187 428/172 |
| 2011/0320930 | A1 | 12/2011 | Liang et al. | |
| 2013/0088712 | A1 | 4/2013 | Holl et al. | |

FOREIGN PATENT DOCUMENTS

| | | | |
|---|---|---|---|
| DE | 102010021803 | A1 | 12/2011 |
| EP | 0553402 | A1 | 8/1993 |
| EP | 0706698 | A1 | 4/1996 |

OTHER PUBLICATIONS

International Search Report for corresponding International PCT Application No. PCT/EP2015/001444, dated Oct. 26, 2015.

* cited by examiner

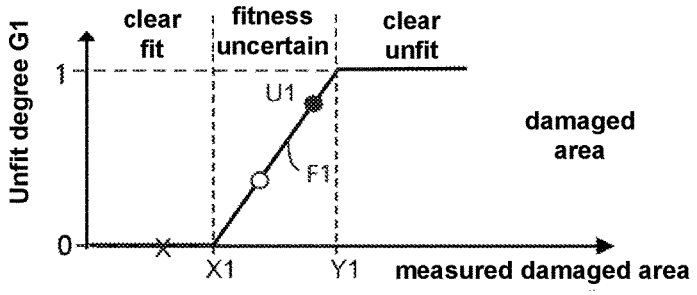
Fig. 5a
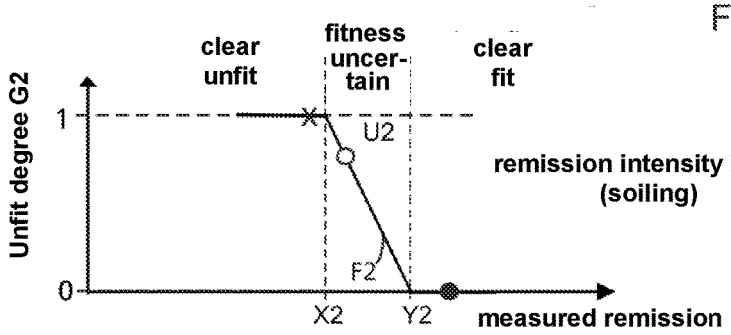
Fig. 5b
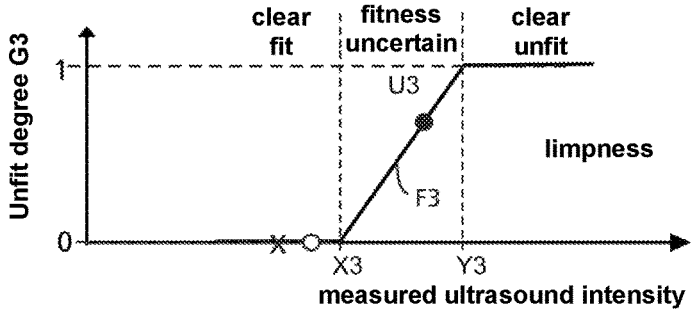
Fig. 5c
| | A● | B○ | C× |
|---|---|---|---|
| G1 | 0,8 | 0,4 | 0 |
| G2 | 0 | 0,75 | 1 |
| G3 | 0,7 | 0 | 0 |
| P | 94% | 85% | 100% |
| T=90% | P>T | P<T | P>T |
|---|---|---|---|
| | unfit | fit | unfit |
Fig. 6a
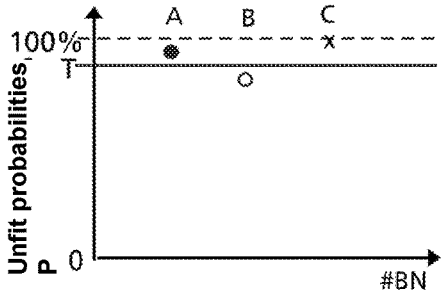
Fig. 6b

METHOD AND DEVICE FOR FITNESS TESTING OF VALUE DOCUMENTS

BACKGROUND

This invention relates to a method and an apparatus for checking the fitness of value documents, such as e.g. bank notes, checks, tickets, . . . . A fitness check for the purposes of the present application is understood to mean the check of used value documents for their fitness for circulation, e.g. of bank notes being in circulation, on the one hand, but also the quality check of new value documents after their manufacturing and before they go into circulation, e.g. the quality check of freshly printed bank notes, on the other hand.

For the fitness check of value documents it is known to check the value documents with the aid of sensors and to compare the fitness measurement values picked up with threshold values, in order to differ between value documents which are fit for circulation (fit), not fit for circulation (unfit), and if required further fitness classes, such as e.g. ATM-fit. It is necessary here that a user of the apparatus carrying out the fitness check, e.g. an operator, an adapteur or a service person of the apparatus, selects and defines suitable threshold values for the sensors. Then these defined threshold values serve to classify the value documents to be checked into value documents fit for circulation and not fit for circulation with the aid of a value-document processing apparatus, and to sort the value documents, for example, into different output pockets of the value-document processing apparatus.

A disadvantage with the known methods is that it is complicated for the user to define suitable threshold values for the sensors. Here, for example threshold values already specified by the manufacturer of a value-document processing apparatus, which are fixedly specified, are assumed. Problems are caused here e.g. by aging or soiling of the value-document processing apparatus or by changes, e.g. aging, of the value documents to be processed in the course of time. If one or several of the threshold values are defined only slightly too high by the user, value documents that are actually no longer fit for circulation are categorized as fit by the bank note processing machine. If, however, one or several of the threshold values are defined only slightly too low by the user, value documents that are actually fit for circulation are categorized as unfit by the bank note processing machine. Thus, the value documents to be processed are not sorted into fit and unfit value documents in the manner desired by the user.

Furthermore, it has hitherto not been taken into account sufficiently that many fitness measurement values contribute to the fitness of the particular value document. It may thus occur that several fitness measurement values respectively are slightly below their threshold values and the relevant value document is categorized as fit, although a human viewer would categorize it—by all appearances—as unfit. Many fitness measurement values also lead to the fitness check becoming hardly manageable for a user of the apparatus for the fitness check—on account of the plurality of threshold values that are necessary therefor. If the user wants to change the severity of the fitness check, e.g. to tighten it, he has to change a plurality of parameters.

SUMMARY

It is hence the object of the present invention to improve the fitness check of value documents.

For checking the fitness of the value documents, at least two different fitness criteria of the value documents are selected which are characteristic for the state of the value documents. The value documents are checked by picking up measurement data, a fitness measurement value for the particular value document being determined from the measurement data picked up for each of the selected fitness criteria. Subsequently, from the particular fitness measurement value for each of the selected fitness criteria, there is determined respectively one unfit degree of the particular value document. The unfit degree is determined with the aid of an unfit function which clearly assigns an unfit degree to each fitness measurement value. Each unfit function is characterized by a first threshold value, a second threshold value, and an uncertainty range between the first and the second threshold value in which the particular unfit function either has a monotonously dropping or a monotonously rising course. Then the unfit degrees of the different fitness criteria are combined into an unfit probability which is specific for the particular value document. On the basis of the unfit probability determined for the particular value document a fitness classification of the particular value document is carried out in which the particular value document is classified as fit or unfit. Besides unfit and fit, one or several further fitness classes can also be provided, e.g. ATM-fit for value documents with particularly great fitness.

If a fitness measurement value is in the uncertainty range according to the invention between the two threshold values, the particular value document is categorized with respect to the particular fitness criterion neither as clearly fit nor as clearly unfit, but obtains a corresponding unfit degree between 0 and 1 for the particular fitness criterion. The particular unfit degree of the particular fitness criterion is a quantitative measure of the fitness of the value document with respect to the particular fitness criterion. For each of the fitness criteria the same value document is assigned an individual unfit degree (valid only for the particular fitness criterion).

With the unfit function according to the invention there is introduced a fuzzy distinction between fit and unfit with respect to the particular fitness criterion. Thus, the fitness check follows the perception of a human viewer. Because also a human viewer would categorize a value document—by all appearances—as unfit, when several fitness criteria are just on the verge of unfit (i.e. the corresponding fitness measurement values are in the uncertainty range of the unfit function). The regions of the particular fitness measurement value beyond the uncertainty range are achieved in the cases in which the viewer would categorize a value document, with respect to the particular fitness criterion, as clearly fit or clearly unfit. The combination of the unfit degrees into an unfit probability reflects the overall impression which a human viewer gets of the fitness of a value document.

By combining the unfit degrees, a common unfit probability for several fitness criteria is determined. The fitness check hence becomes easier to manage for the user of the apparatus. If the user, for instance, wants to change, e.g. intensify, the severity of the fitness check, he can simply achieve this by changing one threshold value with which the unfit probability is compared. The unfit functions of the different fitness criteria do not need to be changed here. Up until now, however, for intensifying the fitness check, all the threshold values had to be intensified individually and for each fitness criterion also the dimension of the shift of the threshold value had to be defined.

In contrast to other methods for checking the fitness, the invention allows an intuitively understandable procedure, because the uncertainty ranges can firstly be defined on the basis of actual comprehensible fitness measurement values and secondly one single unfit probability is derived for the particular value document. Moreover, the method according to the invention also is stable in case of small changes of the fitness of the examined value documents.

The results of the fitness classification can be employed for observing and thus monitoring the development of the fitness of a plurality of value documents in the course of time. If the fitness of the value documents on average does no longer correspond to the specifications made therefor, measurements can be taken in order for the specifications to be again fulfilled in the future. For example, in this way the fitness of used value documents in circulation can be observed and controlled, and also the fitness of new, freshly printed value documents as part of the quality check before the value documents go into circulation. As a parameter for the observation and for comparing, e.g. the number or the portion of value documents (e.g. the unfit portion, the fit portion etc.) classified into a certain fitness class (e.g. as fit or unfit) can be used or a mean value of the unfit probability over the plurality of value documents. E.g. the fitness classifications of the same or of different value-document processing apparatuses can be compared with each other, or of value-document processing apparatuses which are located at different installation sites or check the value documents of different regions.

The invention also relates to an apparatus for checking the fitness of value documents, in particular a value-document processing apparatus configured for checking the fitness having a measuring device for picking up measurement data of the value documents, and an evaluation device for the fitness classification of the value documents on the basis of the measurement data picked up. The evaluation device is configured for selecting at least two different fitness criteria of the value documents, which are characteristic for the state of the value documents, determining, from the measurement data picked up for each of the selected fitness criteria, a fitness measurement value for the particular value document, determining, for each of the selected fitness criteria, respectively one unfit degree from the particular fitness measurement value of the particular value document with the aid of an unfit function, the unfit function clearly assigning to each fitness measurement value an unfit degree and each unfit function being characterized by a first threshold value, a second threshold value, and an uncertainty range between the first and the second threshold value in which the particular unfit function either has a monotonously dropping or a monotonously rising course, and combining the unfit degrees of the different fitness criteria of the particular value document into an unfit probability which is specific for the particular value document, and carrying out a fitness classification of the particular value document on the basis of the unfit probability which was determined for the particular value document.

The value-document processing apparatus configured for checking the fitness further has usually the following devices:

an input pocket for receiving the value documents to be checked, one or several output pockets, a transport device for transporting the value documents from the input pocket past the measuring device into the output pocket/s, a user interface for entering parameters for the fitness check and, where applicable, for the output of the results of the fitness classification, a control device for controlling the apparatus, in order to sort the value documents in dependence on their particular fitness into different output pockets, whereby the control device and the evaluation device can be configured to be together or separated of each other.

In order to ensure the secure separation of fit and unfit value documents, individual threshold values can be employed for each type of value documents, because each value document type has its own physical properties which may strongly differ from each other. In the case of bank notes, e.g. individual threshold values can be employed for each denomination and/or issuance of the particular currency. However, the same threshold values can also be employed for similarly constituted value documents, e.g. for bank notes of different denomination, but of the same currency.

The threshold values for the particular value documents can be defined, or optimized as needed, prior to the fitness check, e.g. upon the adaptation of the particular value document type. The first and/or second threshold value of the unfit function of a fitness criterion can be derived from the hitherto usual (single) threshold value which hitherto has been employed for the fitness check with reference to this fitness criterion. For example, the hitherto threshold value is employed as an upper threshold value of the unfit function and the lower threshold value of the unfit function is selected therebelow. Alternatively, the first and second threshold value can be set symmetrically around the hitherto threshold value.

Selecting the fitness criteria from the various fitness criteria can be carried out manually or automatically. In an automatic selection of the fitness criteria, e.g. at least two predefined fitness criteria are selected which were defined for the particular value documents, e.g. individually for the particular value document type, prior to the fitness check. However, the definition can also be carried by an expert on the basis of empirical values. As fitness criteria there are preferably selected those in which the particular frequency distribution of the fit and unfit value documents are separated as far away from each other as possible or overlap as little as possible. There are selected for example such fitness criteria in which the particular frequency distributions of the fit and unfit value documents have a maximum overlap of 30%.

The value-document processing apparatus can suggest for the user to select such fitness criteria (e.g. display at the user interface of the value-document processing apparatus) which are particularly suitable for the distinction of fit and unfit value documents. Here e.g. those fitness criteria are suggested whose fit and unfit frequency distributions have the lowest overlap. The fitness criteria are displayed e.g. in the order of descending overlap of the frequency distributions at the user interface of the value-document processing apparatus. At the user interface there can be displayed the results of the fitness classification, e.g. the development of the fitness of a plurality of value documents in the course of time or in comparison to results of the fitness classification of other value documents.

The selected fitness criteria relate in particular to one or several of the following properties of the value documents: soiling, wear, damage, alien elements (e.g. adhesive tape) or limpness of the particular value document. Preferably, at least two different fitness criteria of these are selected. If the method according to the invention is employed for the quality check of new value documents, there can also be selected—in addition or instead of these fitness criteria—one or several of the following fitness criteria: quality of the print (color, errors), position of the printed image relative to the value document edges, production quality of authenticity features (e.g. with the help of the optical or magnetic properties thereof), position of authenticity features on the value document, etc.

For example one or several of the following fitness criteria can be selected:

spot size (area) or number of spots, dimension (area) or number of missing parts, e.g. dog-ears, holes, the tear length or tear area, the length or area of an adhesive tape, the degree of soiling of the value document in one or several ROIs (regions of interest), e.g. in an unprinted region of the value document (white field), the rate of wear (abrasion or fading) of the printing ink in a printed region of the value document, the degree of wear of authenticity features.

The relevant fitness measurement values can be quantitatively ascertained e.g. with the help of the locally resolved optical transmission intensity, remission intensity or luminescence intensity and, where applicable, a suitable image processing. The degree of wear of magnetic authenticity features can be quantitatively ascertained with the aid of a magnetic sensor. The measures of adhesive tape or the missing parts can also be ascertained with the help of the ultrasound-transmission intensity. Furthermore, the limpness, folds or creases in the value document can be quantitatively ascertained on the basis of the ultrasound transmission or remission intensity in one or several ROIs or of the entire value document and can be selected as a fitness criterion.

Combining the unfit degrees of the selected fitness criteria is carried out e.g. such that, for each selected fitness criterion, up to a certain fitness measurement value (e.g. up to the first threshold value) the particular fitness criterion does not influence the fitness classification (unfit probability) of the particular value document at all, but that the particular fitness criterion beginning with a certain fitness measurement value (e.g. beginning with the second threshold value) decides the fitness classification of the particular value document, and that the particular fitness criterion in case of fitness measurement values in the uncertainty range influences the fitness classification only partially and in cooperation with the other selected fitness criteria. This is achieved e.g. by the following formula (1).

Upon combining the unfit degrees $G_j$ of the various fitness criteria into the unfit probability P, there can be carried out—for each value document individually—a multiplication of the unfit degrees of the different fitness criteria. The unfit probability P can be determined from the unfit degrees e.g. according to the following formula:

$$P = 1 - \prod_j (1 - G_j)^{k_j} = 1 - (1 - G1)^{k_1} \cdot (1 - G2)^{k_2} \cdot \ldots \quad (1)$$

Upon combining the unfit degrees $G_j$ according to this formula, the fitness criteria with a high unfit degree $G_j$ dominate against the fitness criteria with a low unfit degree $G_j$. Fitness criteria with a very low unfit degree $G_j \approx 0$ (i.e. nearly fit) have a very low influence on the unfit probability P. Already one single unfit degree of approximately 1 (i.e. nearly unfit) causes the resulting unfit probability P of the value document to be also approximately 100%, even when the other unfit degrees of this value document are infinitesimally low (i.e. fit).

An exponent $k_j$ is available for each fitness criterion, which facilitates the use of the fitness check for various value document types, because the fitness check for all value documents can be carried out on the basis of this one generic formula (1) and, where applicable, the exponents $k_j$ can be selected in dependence on the value document type. In the easiest case the exponents are $k_j=1$. The particular unfit degree $G_j$ of the relevant fitness criterion is then "normally" taken into account. By an exponent $k_j=0$ the particular unfit degree $G_j$ can be omitted, i.e. the particular fitness criterion can be left out of consideration. With a nonlinear course of the unfit function in the uncertainty range, by exponents $k_j>1$ there can be generated an approximately linear course of the unfit portion as a function of the fitness threshold.

However, combining the unfit degrees of the different fitness criteria into the unfit probability P can also be carried out by a linear combination of the unfit degrees $G_j$ of the different fitness criteria, in particular by adding up the unfit degrees, where applicable with different weighting of the unfit degrees of different fitness criteria.

The fitness check can be optimized in that from a provided selection of fit and unfit value documents there is respectively ascertained the frequency distribution of the fitness measurement values and this is employed for selecting the fitness criteria or for optimizing the unfit function. The unfit function of the particular fitness criterion is determined e.g. prior to the fitness check, based on fit and unfit value documents, the following steps being carried out:

providing a first group of fit value documents and a second group of unfit value documents. The fit and unfit value documents may belong to the same value document type (the same currency of the bank notes, may be also the same denomination), but may also belong to different types. The categorization as fit or unfit may have been carried out e.g. by a manual check (on the basis of human perception) or by a check by means of a reference measuring system.

checking the fit and the unfit value documents of the first and second group by picking up measurement data of these value documents with the aid of a measuring device, determining at least one fitness measurement value, in particular of at least two different fitness measurement values for each value document, from the measurement data of the particular value document, determining a first frequency distribution of the particular fitness measurement value for the first group of the fit value documents and a second frequency distribution of the particular fitness measurement value for the second group of the unfit value documents, employing the first and second frequency distribution of the particular fitness measurement value (the frequency distribution for the fit value documents and the one for unfit value documents) to select (manually or automatically) the fitness criteria to be employed in the fitness check of the value documents and/or to define or to change (manually or automatically) the unfit function of the particular fitness criterion.

For example, the two frequency distributions of the particular fitness measurement value are employed for defining the first and/or the second threshold value of the particular unfit function for the particular fitness criterion and/or for determining/optimizing the course of the unfit function in the uncertainty range. This can be effected manually by a person or automatically by the apparatus. For example, as an uncertainty range of the unfit function of the particular fitness criterion there is employed a values range of the particular fitness measurement value, in which there are both fitness measurement values of fit value documents and fitness measurement values of unfit value documents. The uncertainty range may comprise the total values range in which there are fitness measurement values of fit value documents as well as of unfit value documents, or also only a portion of this values range.

Alternatively or additionally, the two frequency distributions of the particular fitness measurement value are employed to select those fitness criteria for the fitness classification in which the frequency distribution of the fit value documents and the frequency distribution of the unfit value documents overlap as little as possible (e.g. a maximum overlap of 30% of the two frequency distributions).

When determining the unfit functions, the particular unfit function can e.g. be determined in such a way that a first threshold value of the unfit function is set to a fitness measurement value in which the fit frequency is much higher than the unfit frequency, in particular has at least a certain ratio (e.g. 5:1), and that the second threshold value is set to a fitness measurement value in which the fit frequency is much smaller than the unfit frequency (cf. e.g. the threshold values X1 and Y1 in the histogram FIG. 2*a*). Alternatively, also the added-up frequency distribution (cumulative histogram) of the fitness measurement values can be employed to determine the first and the second threshold value. For example, the first/second threshold value is set to a fitness measurement value in which the added-up frequency of the fit value documents has a certain relation to the added-up frequency of the unfit value documents.

In the uncertainty range of the particular unfit function there can be selected a course of the unfit function which was defined prior to the fitness check for the particular fitness criterion, in particular on the basis of empirical values. However, the definition of the two threshold values can also be effected manually by selecting the particular threshold value from a plurality of specified threshold values.

After a first fitness classification, the unfit function can be optimized by simulation of the fitness classification e.g. to achieve a certain unfit portion. For this, for the value documents of one or several value document groups to be checked (e.g. a certain value document stack including a mixture of fit and unfit value documents) there are carried out the following steps within the framework of a simulation:

ascertaining the unfit portion of the one or several value document groups, which indicates the portion of value documents which were classified as unfit in the fitness classification of the particular value document group, checking the unfit portion for at least one specification determined for the unfit portion (e.g. whether a maximum value for the unfit portion and/or a minimum value for the unfit portion is achieved or a determined specified unfit portion is at least approximately achieved), changing the unfit function of one or several of the employed fitness criteria in dependence on the ascertained unfit portion of the value document group to achieve a changed fitness classification of the value documents. If the ascertained unfit portion fulfills the determined specification here, the unfit function is left unchanged. If the ascertained unfit portion does not fulfil the determined specification, however, the unfit function is changed and the following steps a)-f) are carried out and repeated, where applicable, one time or several times within the framework of the simulation:

a) determining anew the (in general changed) unfit degrees of the particular value document for the at least two different fitness criteria using the changed unfit function of the particular fitness criterion,
b) combining anew the unfit degrees of the different fitness criteria into a (in general changed) unfit probability of the particular value document and
c) classifying anew the fitness of the particular value document with the help of the particular unfit probability,
d) ascertaining anew the (in general changed) unfit portion of the one or several value document groups, which indicates the portion of value documents which are classified as unfit in the fitness classification of the particular value document group,
e) checking anew the newly ascertained unfit portion for the determined specification,
f) changing anew the unfit function of one or several of the employed fitness criteria in dependence on the newly ascertained unfit portion of the value document group, whereby, if the unfit portion ascertained anew fulfills the determined specification, the unfit function is left unchanged, and if the unfit portion ascertained anew does not fulfil the determined specification, the unfit function is changed and the steps a)-f) are repeated one time or, where applicable, several times within the framework of the simulation. As soon as the unfit portion ascertained anew fulfills the determined specification which was defined for the unfit portion, the unfit function is left unchanged and the fitness classification (step c) last carried out is employed as the final fitness classification. Fulfilling the specification may be an approximate achievement of a certain unfit portion. By repeating the steps a)-f) e.g. the difference between the automatically ascertained unfit portion and a specified (e.g. manually ascertained) unfit portion can be minimized. By adapting the ascertained unfit portion to the specified one it is achieved that the standards of the manual fitness check are transferred to the automatic fitness check.

The simulation has the advantage that the optimization of the fitness classification can be carried out without newly picking up measurement data of the value documents to be checked. This avoids an additional mechanical stress of the value documents, which a repeated picking up of measurement data in a value-document processing apparatus would bring along. For example, the simulation is carried out, after the value document check, with the help of a plurality of checked value documents (which were checked, where applicable, by several different value-document processing apparatuses), e.g. by the central bank, in order to control the quality of the bank notes in circulation.

For the above-mentioned changing of the unfit function of the particular fitness criterion, in particular the position of the two threshold values (i.e. the position of the uncertainty range) for the respectively selected fitness criterion and/or the course of the unfit function in the uncertainty range is changed. Upon changing the unfit function of the fitness criterion, the unfit function of this fitness criterion can be changed in dependence on the result of the fitness classification of the value documents of the value document group such that in the repeated fitness classification the unfit portion is, as desired, either increased or decreased. The unfit portion in particular can be adapted to the unfit portion which was detected before in a manual pre-sorting for this value document group.

However, the unfit portion can also be adapted to a specified unfit portion which resulted for the same value document group in one or several other value-document processing apparatuses. For this, the same value document stack is brought to several value-document processing apparatuses and is subjected to a fitness check there (with the same or also with different sensors). Thus an equal status of the fitness check at several value-document processing apparatuses can be achieved. Because the unfit portions achieved in different value-document processing apparatuses have hitherto not always matched, when e.g. the sensors of the value-document processing apparatuses are different, employ different measuring principles or are not calibrated for a match, or when the value document transport is effected with different speeds or by different transport devices.

If the unfit portion is lower than a specified or desired unfit portion, the first and/or the second threshold value is changed such (e.g. one or both are reduced) that upon classifying the fitness anew the severity of the fitness check is increased. If the unfit portion is higher than a specified or desired unfit portion, the first and/or the second threshold value is changed such (e.g. one or both are increased) that upon classifying the fitness anew the severity of the fitness check is decreased. With those fitness criteria in which the unfit degree in the uncertainty range monotonously rises with increasing fitness measurement value (e.g. damaged area), and the unfit portion is too large, one or both threshold values are increased in order to reduce the unfit portion, and if the unfit portion is too low, one or both threshold values are reduced in order to increase the unfit portion. With those fitness criteria in which the unfit degree in the uncertainty range monotonously decreases with increasing fitness measurement value (e.g. remission in the white field), and the unfit portion is too large, one or both threshold values are reduced in order to reduce the unfit portion, and if the unfit portion is too low, one or both threshold values are increased in order to increase the unfit portion.

For the first run of the simulation for the fitness classification, an original unfit function can be employed which was determined e.g. prior to the value document check or was automatically selected. Starting out from this original unfit function, the unfit function is changed with the repeated runs of the simulation.

The unfit function clearly assigns an unfit degree to each fitness measurement value. The unfit degree of the respectively selected fitness criterion is determined by inserting the particular fitness measurement value of the particular value document into the unfit function of the respectively selected fitness criterion. The particular unfit function is a rule through which an unfit degree is assigned to the fitness measurement values which the value documents have with respect to the particular fitness criterion. However, for each fitness criterion there is employed an individual unfit function. The unfit degree is hence specific to the particular fitness criterion.

In the uncertainty range of the unfit function the particular fitness measurement value is categorized neither as clearly fit nor as clearly unfit. The unfit function is thus not only a simple sorting threshold. The uncertainty range is limited by a first and a second threshold value. In the uncertainty range between the first and second threshold value, it assumes either a monotonously dropping or a monotonously rising, in particular a linear or nonlinear course. The unfit function respectively assigns an unfit degree which is greater than 0 and lower than 1 to the fitness measurement values being in the uncertainty range. It assigns to all the fitness measurement values being beyond the first threshold value (i.e. which are on the side facing away from the uncertainty range of the first threshold value) an unfit degree of 0, and to all the fitness measurement values being beyond the second threshold value (i.e. which are on the side facing away from the uncertainty range of the second threshold value) an unfit degree of 1. In particular, the unfit function assigns to all those fitness measurement values which are above the second (upper) threshold value a fitness-criterion-specific unfit degree of 1, and to all those fitness measurement values which are below the first (lower) threshold value, a fitness-criterion-specific unfit degree of 0.

The unfit functions of the selected fitness criteria differ from each other in particular with respect to the position of the first and/or the second threshold value. However, they can differ from each other also with respect to the course of the unfit functions between the first and second threshold value. Preferably, with all the value documents of a value document stack to be checked for fitness, for determining the unfit degree of the particular fitness criterion, the same unfit function is employed.

The unfit probability of the particular value document determined by combining the unfit degrees delivers a quantitative measure of the overall state of the particular value document. The unfit probability can also be determined by combining the unfit degrees of more than two different fitness criteria. In particular, the unfit probability of the particular value document can be determined on the basis of the unfit degrees of at least five, preferably of at least 10 different fitness criteria. Into the combination of the unfit degrees there can additionally also be incorporated at least one unfit degree which was obtained with the hitherto usual sharp separation between fit and unfit (without uncertainty range) for a fitness criterion, i.e. a fitness criterion in which for the particular value document either an unfit degree of 0 or an unfit degree of 1 is employed, but no unfit degrees between 0 and 1, cf. FIG. 1.

In particular, at least one of the fitness measurement values can be an aggregated fitness measurement value, in which at least two various fitness measurement values are aggregated. For example, for a fitness criterion there can be defined several ROIs on the bank note, whose fitness measurement values are then aggregated into one single fitness measurement value. At least one of the unfit degrees which is incorporated into the unfit probability can be a group unfit degree which indicates the fitness of the value document with respect to at least two different fitness criteria, the group unfit degree being determined with the aid of an unfit function which was formulated for the aggregated fitness measurement value. For example, a first group unfit degree is determined for a first group of (at least two) fitness criteria which respectively relate to the soiling of the value document, and a second group unfit degree is determined for a second group of (at least two) fitness criteria which respectively relate to the damage of the value document. Optionally, also a third group unfit degree is formed for a third group of fitness criteria, e.g. for the wear of the value document or the limpness.

The unfit probability of the particular value document is then determined by combining the first group unfit degree relating to the damage with the second group unfit degree relating to the soiling of the bank note and, where applicable, with further unfit degrees, in particular further group unfit degrees. The group unfit degrees have the advantage that they reduce the number of fitness criteria, and thus also the complexity of the fitness check is reduced. For the user of the apparatus the fine adjustment of the fitness check is thus facilitated.

Upon combining the unfit degrees, also such unfit degrees can be combined with each other which are determined from fitness measurement values which were picked up at different positions on the value document which are located in particular in different ROIs of the value document.

For the fitness classification of the value document, the unfit probability determined for the value document e.g. is compared with one single fitness threshold, the value document being classified as unfit when exceeding the fitness threshold and otherwise as fit. The fitness classes fit and/or unfit can respectively be divided into further fitness classes, e.g. the fitness class fit can be divided into the two fitness classes fit and ATM-fit.

The fitness threshold can be changed to control the unfit portion of the value document stack to be checked. For example, a user of the value-document processing apparatus can change the fitness threshold. In this way it is easily possible, without further adaptations or having to adjust further thresholds, to control the severity of the fitness check with respect to all fitness criteria by selecting one single threshold. Moreover, the unfit portion of the value document stack to be checked can easily be changed in this way.

After the check of the value documents there can be carried out, as needed, an advance calculation for the particular checked value document group, in which for different values of the fitness threshold there is determined the respectively expected unfit portion of the particular value document group and ascertained the dependence of the unfit portion on the value of the fitness threshold. This information can be communicated to the user, e.g. outputted at a user interface of the value-document processing apparatus. In particular, the dependence of the unfit portion on the value of the fitness threshold can be represented as a look-up table. The user can then select the fitness threshold with which his favourite unfit portion is achieved in the fitness check. At the user interface there can also be outputted information about the general quality of the processed value documents.

Controlling the unfit portion can also be performed by a central authority which compares the unfit portions of several value-document processing apparatuses with each other and, for adapting them, adjusts accordingly changed fitness thresholds at these value-document processing apparatuses. This can be carried out via remote access of the central authority to the value-document processing apparatuses (e.g. connected in a network).

Upon the fitness classification there can be distinguished further fitness classes, besides the distinction between fit and unfit value documents, for example for value documents which are suitable for an employment in a cash dispensing machine (further fitness class ATM-fit). Such value documents must meet higher requirements with respect to their fitness than it is necessary for the fit-classification, because the frequency of disturbances of the machines depends on the fitness of the value documents.

In the easiest case, for the fitness class ATM-fit there is employed merely a further, lower fitness threshold with which the unfit probability of the particular value document is compared. If the unfit probability is below this further fitness threshold, the value document is classified as ATM-fit. If the unfit probability is below the (above-mentioned) fitness threshold, but above this further fitness threshold, this value document is classified as fit. If the unfit probability is above the (above-mentioned) fitness threshold, the value document is classified as unfit.

Alternatively, upon the decision between the fitness class ATM-fit and the fitness class fit, however, one can also proceed analogously, like in the above-described decision between the fitness class fit and the fitness class unfit. In doing so, for example an ATM-fit-degree is employed—analogous to the unfit degree—and an ATM-fit function is formulated therefor—analogous to the unfit function —, likewise with two threshold values and an uncertainty range in between in which the ATM-fit function monotonously decreases or increases. For fitness measurement values below a first threshold value the ATM-fit-degree is 0, for fitness measurement values above a second threshold value the ATM-fit-degree is 1 and in the uncertainty range the ATM-fit-degree is between 0 and 1. For the decision fit or unfit and the distinction between fit or ATM-fit, the same but also other fitness criteria can be selected. If one views the same fitness criterion, the two threshold values for the decision fit or ATM-fit are different from those for the decision fit or unfit, namely such that for the fitness class ATM-fit higher requirements on the fitness are imposed than for the fitness class fit. Depending on the fitness criterion, higher requirements on the fitness are achieved either through higher threshold values or through lower threshold values. The ATM-fit degrees of the fitness criteria selected for this decision are combined—analogous to the unfit probability—into an ATM-fit probability of the particular value document. Upon the fitness classification of the value document there is then decided with the help of the ATM-fit probability whether the particular value document is ATM-fit or not, e.g. by comparing it with an ATM-fit threshold.

BRIEF DESCRIPTION OF THE DRAWINGS

Further advantages of the present invention are to be found in the dependent claims and in the following description of the embodiment examples. There are shown:

DETAILED DESCRIPTION OF VARIOUS EMBODIMENTS

Figure 4:
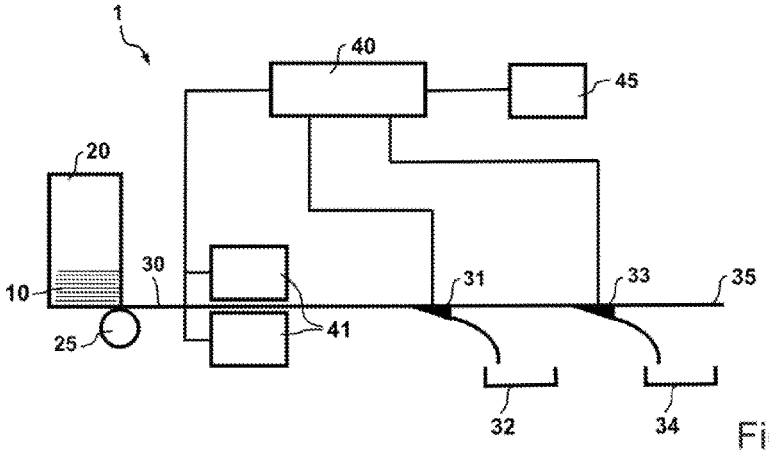

In FIG. 4 there is represented a bank note processing machine 1 having an input pocket 20 into which bank notes 10 to be processed can be inserted, e.g. bank notes that are to be separated into bank notes fit for circulation (fit) and those unfit for circulation (unfit). The bank notes 10 are transferred by a singler 25 singly, one after the other, to a transport system 30. The transport system 30 transports the single bank notes through the bank note processing machine, past a measuring device 41 into one or several output pockets 32, 34. In doing so, the bank notes of different fitness can be sorted into different output pockets.

The measuring device 41 includes one or several sensors whose measurement data allow inferences about the state of the particular bank note, so that the bank note can be evaluated and categorized as fit or unfit. The sensors of the measuring device 41 may be for example one or several optical sensors having suitable light sources, the sensors detecting light reflected by the particular bank note or transmitted through the particular bank note, e.g. light of a certain wavelength or a certain wavelength range. Further sensors can check for example acoustic (e.g. ultrasound) and/or mechanical (e.g. thickness measurement) and/or thermal and/or magnetic and/or electrical properties of the particular bank note. The measurement data of the stated sensors permit statements on whether the particular bank note is soiled or damaged or whether it has alien elements such as clips or adhesive tape which affect the fitness for circulation of the particular bank note.

On the basis of the measurement data provided by the measuring device 41, an evaluation device 40 determines the fitness of the particular bank note, e.g. whether the particular bank note is a fit or an unfit bank note. The evaluation device 40 has e.g. a microprocessor which executes software for the fitness check which is stored in an associated memory. In dependence on the fitness of the bank note detected by the evaluation device 40, gates 31 and 33 are driven in the transport system 30 to place for example fit bank notes in a first output pocket 32 and unfit bank notes in a second output pocket 34. Further gates or output pockets may be provided in the transport system 30 of the bank note processing machine 1 and are indicated by a continuation 35.

A user interface 45 connected to the evaluation device 40 and consisting e.g. of a keyboard and a display or a touchscreen is employed for operating the bank note processing machine 1 by an operator. Via the user interface 45 commands can be entered or processing modes can be selected and processing results can be displayed or the user can be prompted by means of instructions to perform certain actions. The user interface can be accessed directly or also by means of remote control.

For checking the fitness of bank notes with respect to a certain fitness criterion, hitherto usually a fitness measurement value M of the bank note is compared with one single threshold value X. This threshold value is selected such that it is at a fitness measurement value between the frequency distribution for fit bank notes and the frequency distribution for unfit bank notes, cf. FIG. 1*a*. If the fitness measurement value of the bank note is above the particular threshold value X, the particular bank note is classified as unfit, otherwise as fit, cf. FIG. 1*b*. Hitherto, for each fitness criterion there is carried out such a comparison, and if one (or several) of the fitness measurement values M of the bank note exceeds its particular threshold value X, the particular bank note is categorized as unfit.

Figure 1A:
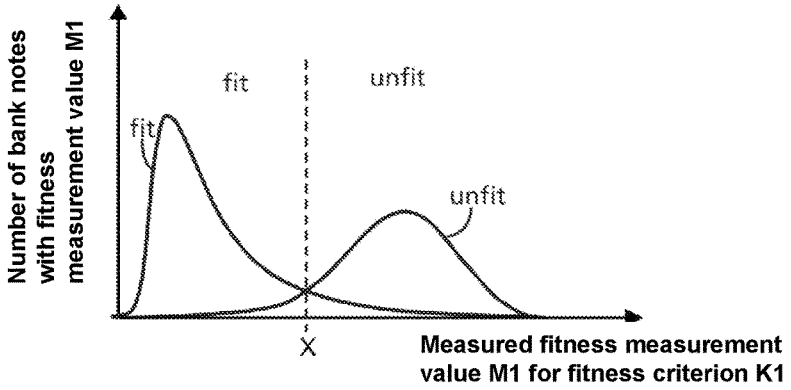
FIG. 1*a* frequency distribution of the fitness measurement value M1 for value documents which are fit for circulation (fit) and non-fit for circulation (unfit), FIG. 1*b* hitherto usual fitness classification by means of a threshold, FIG. 2*a* frequency distribution of the fitness measurement value M1 of a fitness criterion K1 for fit and for unfit value documents, FIGS. 2*b-c* two examples of an unfit function for fitness criterion K1, FIG. 3*a* frequency distribution of the fitness measurement value M2 of a fitness criterion K2 for fit and for unfit value documents, FIG. 3*b* example of an unfit function for the fitness criterion K2, FIG. 4 basic structure of a bank note processing machine, FIGS. 5*a-c* unfit functions for three different fitness criteria, FIGS. 6*a-b* table for the fitness evaluation (FIG. 6*a*) with the help of three different fitness criteria and unfit probability (FIG. 6*b*) ascertained therefrom for three value documents A, B, C FIGS. 7*a-b* aggregating of fitness measurement values and group unfit degree for the aggregated fitness measurement value.
Figure 1B:
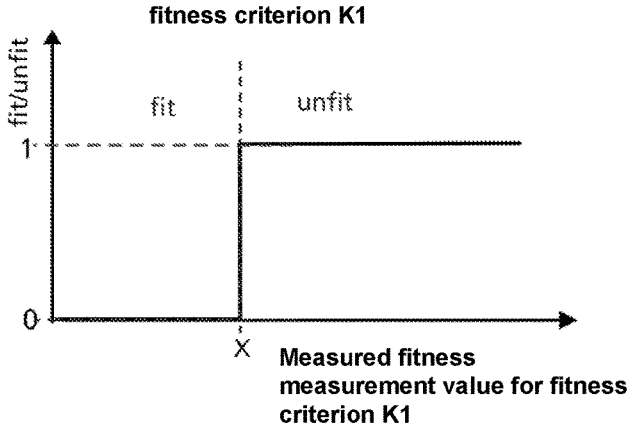
Figure 2A:
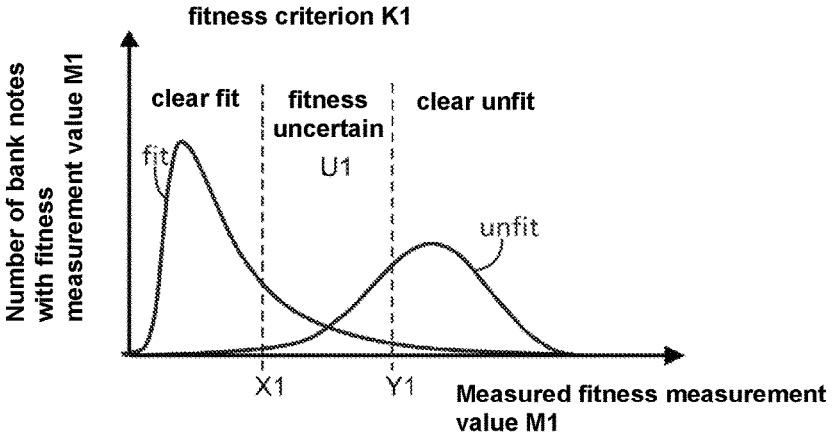
Figure 2B:
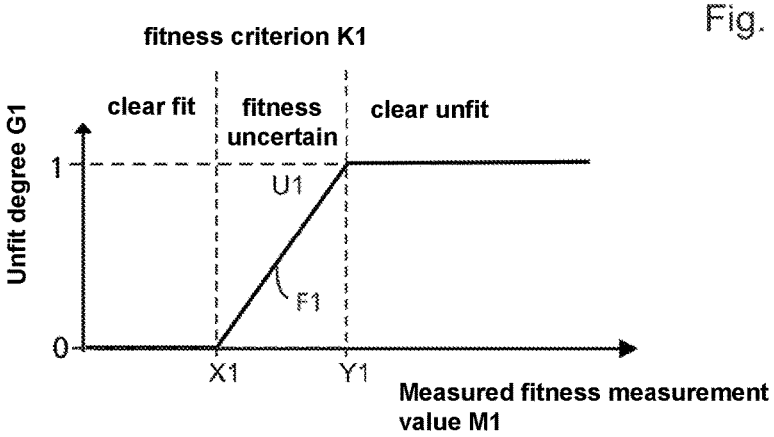
Figure 2C:
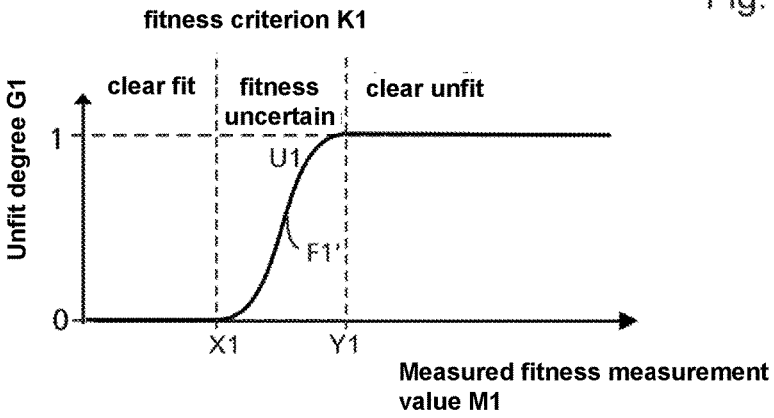

In FIG. 2*a* there are shown the same two frequency distributions for a fitness measurement value M1 of a fitness criterion K1 as in FIG. 1*a*, but now an upper threshold value X1 and a lower threshold value Y1 are employed which limit an uncertainty range U1 in which the bank notes neither are classified as clearly fit nor as clearly unfit. In the case of the fitness criterion K1, a high fitness measurement value M1 indicates the presence of an unfit bank note. If the fitness measurement value M1 is above the upper threshold value Y1, the bank note is categorized—with respect to the particular fitness criterion K1—as clearly unfit (unfit degree 1), below the lower threshold value X1 as clearly fit (unfit degree 0). For fitness measurement values being in the uncertainty range U1 between X1 and Y1 the unfit degree is between 0 and 1. The value of this unfit degree depends on the course of the selected unfit function F1. In the example of FIG. 2*b*, for the fitness criterion K1 there was employed a linear, monotonously rising course of the unfit function. However, there can alternatively also be employed an unfit function F1' which has in the uncertainty range U1 a nonlinear, monotonously rising course, e.g. an S-shaped course, cf. FIG. 2*c*. The nonlinearity e.g. can be advantageous when in the overlapping region of the two frequency distributions the frequency curves behave in a nonlinear fashion.

Figure 3A:
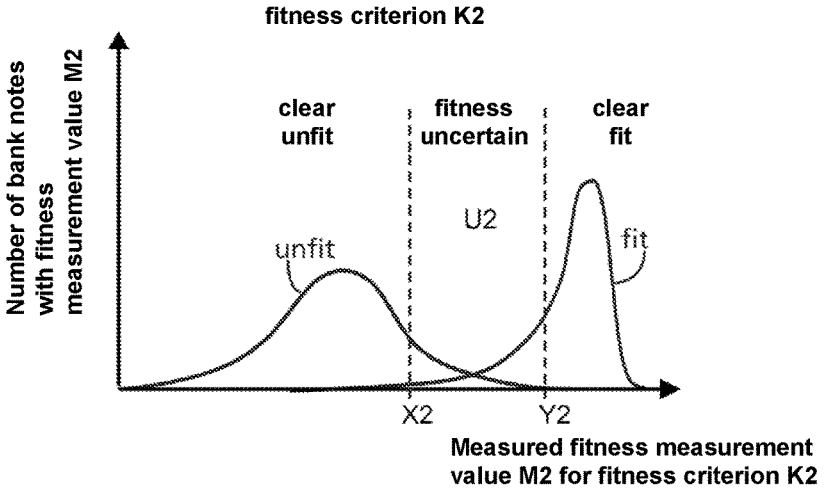
Figure 3B:
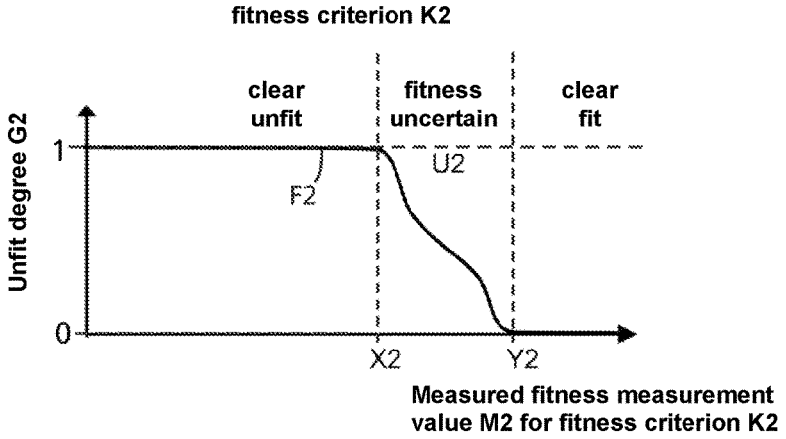

In FIG. 3*a-b* there is shown an example of a different fitness criterion K2, in which a low fitness measurement value M2 indicates the presence of an unfit bank note. Accordingly, the frequency distribution of the unfit bank notes has relatively low fitness measurement values M2 in comparison to the frequency distribution of the fit bank notes. Accordingly, there is employed an unfit function with a reversed course, i.e. which in the uncertainty range U2 monotonously drops from 1 to 0. If the fitness measurement value M2 is above the upper threshold value Y2, the bank note is categorized—with respect to the fitness criterion K2—as clearly fit (unfit degree 0), below the lower threshold value X2 as clearly unfit (unfit degree 1). Here too, the unfit function has a nonlinear course in the uncertainty range.

In FIG. 5*a-c* there are shown by way of example three unfit functions F2, F2, F3 for three different fitness criteria which are characterized by the uncertainty ranges U1, U2, U3 and the threshold values X1, Y1, X2, Y2, X3, Y3. FIG. 5*a* shows the unfit function F1 for a fitness criterion which relates to the damage of the bank note, as a fitness measurement value the damaged area of the bank note being employed here. FIG. 5*b* shows the unfit function for a fitness criterion F2 which relates to the soiling of the bank note, as a fitness measurement value the remission intensity of the bank note in one or several ROIs being employed here. In FIG. 5C there is shown the unfit function F3 for a fitness criterion which relates to the limpness of the bank note, as a fitness measurement value the ultrasonic intensity transmitted through the bank note being employed here.

The damaged area is e.g. the sum of all damaged areas of the particular bank note (damages like holes, tears, dog-ears etc.) as they result from a picture of the bank note taken with an optical sensor with the aid of known image processing methods. The remission is measured e.g. in one or several spectral channels in one or several ROIs on the bank note in which the soiling of the particular bank note is checked. The limpness is detected e.g. with the aid of an ultrasound-transmission measurement.

Moreover, in FIG. 5*a-c* there are exemplary stated the fitness measurement values M for these three fitness criteria for three bank notes A, B and C, as symbols there being employed for the bank note A the black circle, for bank note B the white circle and for the bank note C the cross. From the particular fitness measurement value M there results for each individual bank note A, B, C from the particular unfit function F1, F2, F3 respectively an unfit degree G1, G2, G3.

In the table of FIG. 6*a*, the particular unfit degrees G1, G2 and G3 are plotted for these three bank notes A, B and C. With respect to damages, the bank note A is assigned an unfit degree G1 of 0.80 because of its damaged area, the bank note B an unfit degree G1 of 0.40, and the bank note C an unfit degree G1 of 0. With respect to soiling, the bank note A is assigned an unfit degree G2 of 0 because of its remission, the bank note B an unfit degree G2 of 0.75, and the bank note C an unfit degree G2 of 1. With respect to limpness, the bank note A is assigned an unfit degree G3 of 0.7 because of its ultrasound measurement value, the bank note B an unfit degree G3 of 0, and the bank note C an unfit degree G3 of 0. In the example of FIG. 5, into the unfit degrees G1, G2 and G3 there can respectively also be incorporated several fitness measurement values, e.g. for the soiling check there can be defined several ROIs on the bank note, the fitness measurement values thereof can then be aggregated into one single fitness measurement value, e.g. by adding up, where applicable with different weighting, or multiplying, where applicable with exponents $k \neq 1$.

For each individual bank note, the particular unfit degrees G1, G2, G3 are now combined into an unfit probability P. For this, the unfit degrees can e.g. be multiplied with each other according to the following formula, in which the exponents $k_1=k_2=k_3=1$ were set:

$$P = 1 - \prod_j (1 - G_j)^{k_j} = 1 - (1 - G1)^{k_1} \cdot (1 - G2)^{k_2} \cdot (1 - G3)^{k_3} == 1 - (1 - G1) \cdot (1 - G2) \cdot (1 - G3) \quad (2)$$

This multiplication ensures that a bank note which has an unfit degree of 1 in at least one fitness criterion will altogether get an unfit probability of 100%, independent of the unfit degrees which this bank note has in the other fitness criteria. For example, the soiling unfit degree G2=1 for the bank note C leads to an unfit probability of the bank note C of P=100%, irrespective of how low the unfit degree for limpness and damage may be.

In FIG. 6*b*, there are shown the unfit probabilities P calculated in this way for the three bank notes A, B and C and a fitness threshold T usable for the fitness classification thereof, e.g. T=90%. Since the unfit probabilities P of the bank note B are below the fitness threshold T=90%, bank note B is classified as fit. Since the unfit probabilities P of the bank notes A and C are above the fitness threshold T, the bank notes A and C are classified as unfit and can be sorted out by the bank note processing machine. Additionally, for the fitness class ATM-fit there can be employed a further fitness threshold T' which is below the fitness threshold T, i.e. for being classified as ATM-fit the bank notes need an even lower unfit probability. For example, for this, the unfit probability P is compared with the further fitness threshold T'.

In the fitness check of the bank note stack 10 to be checked, an unfit probability P is determined for each of these value documents. This unfit probability P is compared with a fitness threshold T which is for the overall state of the value documents. This fitness threshold T can be specified by the user or prior to the value document check, e.g. upon adaptation, or also by remote access from a central place. With a defined fitness threshold there then results from the number of the bank notes whose unfit probability P exceeds this fitness threshold T a corresponding unfit portion, e.g. 20%.

However, it can also be provided that the user states, by means of the user interface 45, a desired unfit portion for bank notes to be classified as unfit, e.g. in percent. If for example not 20% but only 10% of the bank notes of the bank note stack 10 are to be categorized as unfit, the fitness threshold T is changed such that only 10% of the bank notes exceed the fitness threshold. For achieving this, starting out from the fitness threshold $T_{20}$ which has led to a 20% unfit portion, the evaluation device would then set the fitness threshold T accordingly higher ($T_{10}$)—taking into account the frequency of the unfit probabilities in this bank note stack. Where applicable, the bank notes of the bank note stack 10 can subsequently be checked anew—with the fitness threshold $T_{10}$—and sorted according to their fitness.

For defining the unfit functions, the procedure may be as follows: Prior to the fitness check of a bank note stack to be checked, the user selects a first group of bank notes which he classifies as fit, i.e. these bank notes have e.g. at most a low soiling and/or damage which is not felt to be disturbing, and a second group of bank notes which he categorizes as unfit, i.e. these bank notes have striking features like soiling, damage, clips, adhesive tape, etc. By means of the user interface 45 the user selects a configuration operating mode of the bank note processing machine 1, in which parameters for the fitness check can be adjusted, in particular which fitness criteria are to be employed for the fitness check, and/or in which the unfit functions and their threshold values can be defined or changed.

In the configuration operating mode the user is prompted for example to first insert the bank notes which he has categorized as unfit into the input pocket 20. The bank notes categorized as unfit are grasped singly by the singler 25 and transferred to the transport system 30. The measuring device 41, or the sensor or sensors contained therein, determine measurement data representative of the particular bank note which are transmitted to the evaluation device 40. After all the bank notes categorized as unfit were processed, the user is prompted to insert the bank notes categorized as fit into the input pocket 20 which then are processed analogously to the bank notes fit for circulation. Alternatively, in the operating mode for defining the threshold value or threshold values the unfit and the fit bank notes can also be inserted together into the input pocket 20, if these can be clearly separated from each other by the bank note processing machine 1, e.g. by means of a separation card which is included between the unfit and the fit bank notes. During processing, the separation card is recognized by the control device 40 with the help of the measurement data of the measuring device 41, so that the separation between unfit and fit bank notes can be performed by the control device 40.

The parameters for the fitness check are then adjusted with the help of the frequency distributions of the fitness measurement values of the fit and the unfit bank notes. This can be effected manually by the user (operator, adapteur, service person), but also automatically by the evaluation device of the value-document processing apparatus. For example, the first threshold value is set to a fitness measurement value at which the fit frequency is much higher than the unfit frequency (e.g. at least has a certain ratio, e.g. 5:1 or 10:1) and the second threshold value is set to a fitness measurement value at which the fit frequency is much lower than the unfit frequency, e.g. has at least a certain ratio (e.g. 1:5 or 1:10). Then the uncertainty range accordingly is in the overlapping region of the two frequency distributions.

Figure 7A:
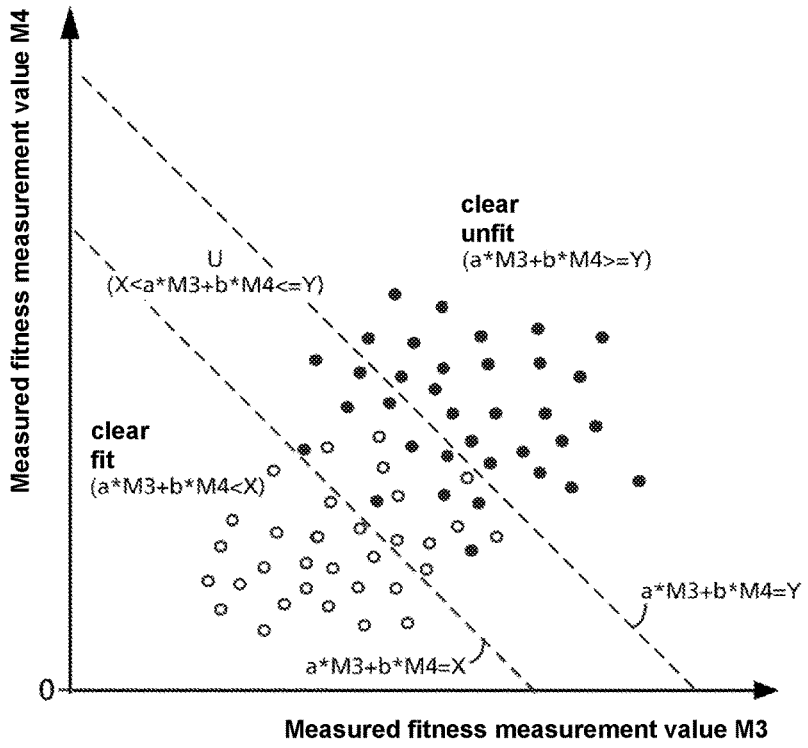

For reducing the number of fitness criteria which must be adapted by a user, several fitness criteria can be aggregated, e.g. several fitness criteria relating to the damage of the bank note. For example, the damaged area can be employed as a fitness criterion K3 and the tear length of the particular bank note as a fitness criterion K4. The fitness measurement values M3 and M4 of the two fitness criteria are aggregated e.g. by a linear combination into the fitness measurement value MK=a*M3+b*M4, into which the fitness measurement values M3 and M4 may be included with different weighting a, b. The result of the linear combination delivers the combined fitness measurement value MK. In FIG. 7*a*, there can bee seen the distributions of the two fitness measurement values M3 and M4 for a group of unfit bank notes which are respectively represented by a black circle, and for a group of fit bank notes which are respectively represented by a white circle. Moreover, a two-dimensional region "clearly fit" is shown in which the group unfit degree is 0, and a two-dimensional region "clearly unfit" in which the group unfit degree is 1. The two threshold values X and Y are formed, in the two-dimensional case, by the two straight lines a*M3+b*M4=X and a*M3+b*M4=Y. A bank note in which there is a*M3+b*M4<X (i.e. MK<X) is categorized, with respect to the combined fitness measurement value MK, as clearly fit (group unfit degree=0), a bank note in which there is a*M1+b*M2>Y (i.e. MK>Y) is categorized, with respect to the combined fitness measurement value MK, as clearly unfit (group unfit degree=1), a bank note in which there applies X<a*M1+b*M2<Y (i.e. X<MK<Y) is in the uncertainty range U in which it has, with respect to combined fitness measurement value, a group unfit degree between 0 and 1.

Figure 7B:
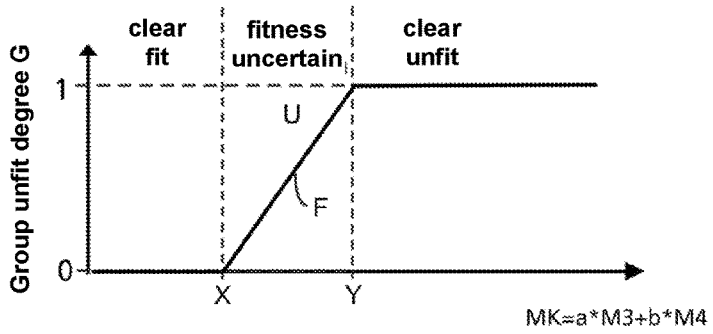

In FIG. 7*b* it is shown how for the aggregated fitness measurement value MK, which was aggregated from the group of the fitness measurement values M3 and M4, the group unfit degree G can be determined. For this, for the combined fitness measurement value MK there is formulated an unfit function F according to the invention with two threshold values X, Y and uncertainty range U in between. With the aid of the unfit function of FIG. 7*b* there results the group unfit degree G. The unfit probability P of the particular bank note then results from combining the group unfit degree G, which relates e.g. to the damage, with one or several other unfit degrees of individual fitness criteria and/or with one or several other group unfit degrees, e.g. with a group unfit degree relating to the soiling of the bank note. The combination of all unfit degrees is effected e.g. by multiplication of these unfit degrees according to formula (1) or by linear combination.

Since by aggregating the fitness measurement values into one single fitness measurement value the number of fitness measurement values is reduced, thus the complexity (dimensionality) of the fitness check is reduced. This simplification of the fitness check is easier to comprehend and clearer for the user of the bank note machine. Thus it becomes easier for a user to perform manual adaptations of the severity of the fitness check.

The invention claimed is:

1. A method for checking the fitness of value documents (A, B, C), comprising the following steps:

selecting at least two different fitness criteria (K1, K2) of the value documents which are characteristic for the state of the value documents, checking the value documents by picking up measurement data of the value documents, wherein, from the measurement data picked up for each of the selected fitness criteria, a fitness measurement value (M1, M2) for the particular value document is determined, determining respectively an unfit degree (G1, G2) for each of the selected fitness criteria (K1, K2) from the particular fitness measurement value of the particular value document (A, B, C) with the aid of an unfit function (F1, F2) which clearly assigns an unfit degree (G1, G2) to each fitness measurement value (M1, M2), wherein each unfit function is characterized by a first threshold value (X1, X2), a second threshold value (Y1, Y2), and an uncertainty range (U1, U2) being between the first and the second threshold value in which the particular unfit function either has a monotonously dropping course that drops from a maximum unfit degree to a minimum unfit degree or a monotonously rising course that rises from the minimum unfit degree to the maximum unfit degree, and combining the unfit degrees (G1, G2) of the different fitness criteria (K1, K2) into an unfit probability (P) which is specific for the particular value document (A, B, C), and fitness classification of the particular value document on the basis of the unfit probability (P) which was determined for the particular value document.

2. The method according to claim 1, wherein the unfit function (F1, F2) assigns to the fitness measurement values (M1, M2) being in the uncertainty range respectively one unfit degree (G1, G2) which is greater than 0 and lower than 1 and between the first and second threshold value either assumes a monotonously dropping or monotonously rising, e.g. linear or nonlinear, course, wherein the unfit function assigns in particular an unfit degree of 0 to all fitness measurement values being beyond the first threshold value and assigns an unfit degree of 1 to all fitness measurement values being beyond the second threshold value.

3. The method according to claim 1, wherein the selected fitness criteria (K1, K2) relate to one or several of the following properties of the value documents: soiling, wear, damage, alien elements or limpness of the particular value document, wherein the selected fitness criteria preferably relate to at least two different ones of these properties.

4. The method according to claim 1, wherein at least two such fitness criteria are selected in which the frequency distribution of the fit value documents and the frequency distribution of the unfit value documents overlap each other as little as possible, wherein the two frequency distributions preferably have a maximum overlap of 30%.

5. The method according to claim 1, wherein upon combining the unfit degrees (G1, G2, . . . ) of the different fitness criteria (K1, K2) into the unfit probability (P) there is carried out a multiplication of the unfit degrees of the different fitness criteria, in particular that the unfit probability (P) is determined from the unfit degrees (G2, G2) according to the following formula:

$$P = 1 - \prod_j (1 - G_j)^{k_j} = 1 - (1 - G1)^{k_1} \cdot (1 - G2)^{k_2} \cdot \ldots \ .$$

6. The method according to claim 1, wherein upon combining the unfit degrees (G1, G2, . . . ) of the different fitness criteria into the unfit probability (P) there is formed a linear combination of the unfit degrees of the different fitness criteria, in particular by adding up the unfit degrees (G1, G2, . . . ) of the different fitness criteria, where applicable with different weighting of the unfit degrees.

7. The method according to claim 1, wherein, for the fitness classification of the particular value document, the unfit probability (P) determined for the value document is compared with a fitness threshold (T) and the value document is classified as unfit, if the unfit probability (P) exceeds the fitness thresholds (T).

8. The method according to claim 1, wherein upon the fitness classification of the value documents of a value document group to be checked for fitness there is carried out an advance calculation, in which, for different values of the fitness thresholds (T), respectively the expected unfit portion of the particular value document group is determined, which indicates the portion of value documents which are classified as unfit in the fitness classification of the particular value document group, and that information is generated about how the unfit portion depends on the value of the fitness threshold (T), wherein this information in particular is communicated to the user of a value-document processing apparatus carrying out the method for checking the fitness, e.g. by outputting it at a user interface of the value-document processing apparatus.

9. The method according to claim 1, wherein prior to the fitness check the following steps are carried out:

providing a first group of fit value documents and a second group of unfit value documents, wherein the categorization of the value documents as fit or unfit was carried out in particular by a manual check by a person or by checking the value documents by means of a reference measuring system, checking the fit and the unfit value documents of the first and second group by picking up measurement data of these value documents with the aid of a measuring device, determining at least one fitness measurement value (M1, M2) for each of the value documents from the measurement data of the particular value document, determining a first frequency distribution of the particular fitness measurement value for the first group of the fit value documents and a second frequency distribution of the particular fitness measurement value for the second group of the unfit value documents, employing the first and second frequency distribution of the particular fitness measurement value (M1, M2) to select the fitness criteria (K1, K2) to be employed in the fitness check of the value documents and/or to determine the unfit function (U1, U2) of the particular fitness criterion (K1, K2).

10. The method according to claim 1, wherein for the value documents of at least one value document group to be checked for fitness the following steps are carried out after the fitness classification of the value documents of the value document group:

ascertaining the unfit portion of the value document group, which indicates the portion of value documents which are classified as unfit in the fitness classification of the value document group, checking the unfit portion for at least one specification determined for the unfit portion, changing the unfit function (U1, U2) of one or several of the employed fitness criteria (K1, K2) in dependence on the ascertained unfit portion of the value document group, wherein, if the ascertained unfit portion fulfills the determined specification, the unfit function is left unchanged, and if the unfit portion does not fulfil the determined specification, the unfit function is changed and the following steps a)-f) are carried out, within the framework of a simulation, using the changed unfit function:

a) determining anew the unfit degrees (G1, G2) of the particular value document for the at least two different fitness criteria (K1, K2) from the particular fitness measurement value using the changed unfit function of the particular fitness criterion, b) combining anew the unfit degrees of the different fitness criteria into an unfit probability (P) of the particular value document and c) classifying anew the fitness of the particular value document with the help of the particular unfit probability (P), d) ascertaining anew the unfit portion of the one or several value document groups, which indicates the portion of value documents which are classified as unfit in the fitness classification of the particular value document group, e) checking anew the unfit portion for the determined specification, f) changing anew the unfit function of one or several of the employed fitness criteria in dependence on the ascertained unfit portion of the value document group, wherein, if the ascertained unfit portion fulfills the determined specification, the unfit function is left unchanged, and if the ascertained unfit portion does not fulfil the determined specification, the unfit function is changed and the steps a)-f) are repeated within the framework of the simulation.

11. The method according to claim 10, wherein as soon as the unfit portion fulfills the determined specification, the unfit function is left unchanged and the fitness classification (step c) last carried out is employed as the final fitness classification and/or that then the unfit function last employed (for the fitness classification in step c) is employed for the future fitness classification of further value document groups, in particular for further value document groups of the same value document type.

12. The method according to claim 10, wherein upon changing the unfit function (U1, U2) of the particular fitness criterion (K1, K2), the unfit function of this fitness criterion is changed in dependence on the unfit portion of the value document group such that the unfit portion upon the new fitness classification is changed in comparison to the unfit portion ascertained before, for example is increased or is decreased, wherein the steps a)-f) according to claim 10 in particular are repeated so often, until the newly ascertained unfit portion corresponds at least approximately to that unfit portion which was detected before in a manual fitness check or in an automatic fitness check with the aid of a value-document processing apparatus for this value document group.

13. The method according to claim 1, wherein at least one of the fitness measurement values (M1, M2) is an aggregated fitness measurement value (MK), in which there are aggregated at least two different fitness measurement values (M3, M4), e.g. by linear combination of these fitness measurement values (M1, M2), and that at least one of the unfit degrees (G1, G2) is a group unfit degree (G) which indicates the fitness of the particular value document with respect to at least two different fitness criteria, wherein the group unfit degree (G) is determined with the aid of an unfit function (F) which was formulated for the aggregated fitness measurement value (MK).

14. The method according to claim 13, wherein for the value documents there is respectively determined a first group unfit degree (G) for a first group of at least two fitness criteria which respectively relate to the soiling of the particular value document, and that there is determined a second group unfit degree for a second group of at least two fitness criteria which respectively relate to the damage of the particular value document, wherein the unfit probability (P) of the particular value document in particular is determined by combining the first group unfit degree (G) relating to the damage with the second group unfit degree relating to the soiling of the bank note, and where applicable with one or several further unfit degrees and/or group unfit degrees.

15. An apparatus for checking the fitness of value documents (A, B, C), comprising:

a measuring device for picking up measurement data of the value documents, and an evaluation device for the fitness classification of the value documents on the basis of the measurement data picked up, wherein the evaluation device is configured for selecting at least two different fitness criteria (K1, K2) of the value documents, which are characteristic for the state of the value documents, determining, from the measurement data picked up for each of the selected fitness criteria, a fitness measurement value (M1, M2) for the particular value document, determining respectively an unfit degree (G1, G2) for each of the selected fitness criteria (K1, K2) from the particular fitness measurement value of the particular value document (A, B, C) with the aid of an unfit function (F1, F2) which clearly assigns an unfit degree (G1, G2) to each fitness measurement value (M1, M2), wherein each unfit function is characterized by a first threshold value (X1, X2), a second threshold value (Y1, Y2), and an uncertainty range (U1, U2) being between the first and the second threshold value in which the particular unfit function either has a monotonously dropping course that drops from a maximum unfit degree to a minimum unfit degree or a monotonously rising course that rises from the minimum unfit degree to the maximum unfit degree, and combining the unfit degrees (G1, G2) of the different fitness criteria (K1, K2) of the particular value document into an unfit probability (P) which is specific for the particular value document (A, B, C), and carrying out a fitness classification of the particular value document (A, B, C) on the basis of the unfit probability (P) which was determined for the particular value document.

16. An apparatus for checking the fitness of value documents (A, B, C), comprising:

a measuring device for picking up measurement data of the value documents, and an evaluation device for the fitness classification of the value documents on the basis of the measurement data picked up, wherein the evaluation device is configured for selecting at least two different fitness criteria (K1, K2) of the value documents, which are characteristic for the state of the value documents, determining, from the measurement data picked up for each of the selected fitness criteria, a fitness measurement value (M1, M2) for the particular value document, determining, for each of the selected fitness criteria, respectively one unfit degree (G1, G2) from the particular fitness measurement value of the particular value document with the aid of an unfit function (F1, F2), wherein, the unfit function (F1, F2) clearly assigns an unfit degree (G1, G2) to each fitness measurement value (M1, M2), and wherein each unfit function is characterized by a first threshold value (X1, X2), a second threshold value (Y1, Y2), and an uncertainty range (U1, U2) being between the first and the second threshold value in which the particular value document is categorized neither as clearly fit nor as clearly unfit with respect to the selected fitness criterion, wherein if the particular fitness measurement value of the selected fitness criterion is beyond the uncertainty range the particular value document is categorized as clearly fit or clearly unfit respectively, and combining the unfit degrees (G1, G2) of the different fitness criteria (K1, K2) of the particular value document into an unfit probability (P) which is specific for the particular value document (A, B, C), and carrying out a fitness classification of the particular value document (A, B, C) on the basis of the unfit probability (P) which was determined for the particular value document.

* * * * *